United States Patent [19]

Willis et al.

[11] 4,188,310

[45] Feb. 12, 1980

[54] SUBSTITUTED CYCLIC ALCOHOLS, METHODS OF PREPARING AND COMPOSITIONS CONTAINING SAME

[75] Inventors: Brian J. Willis, Bergenfield; John M. Yurecko, Jr., Bayonne, both of N.J.

[73] Assignee: Fritzsche Dodge & Olcott Inc., New York, N.Y.

[21] Appl. No.: 957,047

[22] Filed: Nov. 2, 1978

[30] Foreign Application Priority Data

Sep. 30, 1977 [JP] Japan ..... 52-118070

[51] Int. Cl.[2] ..... A61K 7/46; C11B 9/00; C07C 35/21; C07C 49/36

[52] U.S. Cl. ..... 252/522 R; 260/586 R; 260/586 P; 560/118; 568/816

[58] Field of Search ..... 560/118, 126; 260/586 R, 586 P; 568/816; 252/522

[56] References Cited

U.S. PATENT DOCUMENTS

| | | | |
|---|---|---|---|
| 2,283,437 | 5/1942 | Hentrich et al. | 568/816 |
| 2,576,078 | 11/1951 | Pelton | 568/816 |
| 2,985,635 | 5/1961 | Wassermann | 568/816 |
| 3,962,147 | 6/1976 | Maurer et al. | 568/816 |
| 3,984,354 | 10/1976 | Schleppnik | 252/522 |

OTHER PUBLICATIONS

Lamant et al, "Comptes, rend.," vol. 250, 362–364 (1960).

Dauber et al, "J.A.C.S.," vol. 97, No. 6, 1622–1623 (1975).

Blakely et al, "Nature" vol. 187, 662 (1960).

*Primary Examiner*—Norman Morgenstern

*Attorney, Agent, or Firm*—Cooper, Dunham, Clark, Griffin & Moran

[57] ABSTRACT

The present invention relates to novel compounds useful as fragrance materials which have the structure

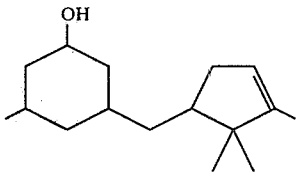

wherein the dashed line may be either a carbon-carbon single bond or a carbon-carbon double bond. The invention also provides methods of preparing these compounds from the reaction products of acetoacetic esters and 2,2,3-trimethyl-3-cyclopenten-1-acetaldehyde and fragrance compositions which include the compounds.

14 Claims, No Drawings

SUBSTITUTED CYCLIC ALCOHOLS, METHODS OF PREPARING AND COMPOSITIONS CONTAINING SAME

BACKGROUND OF THE INVENTION

The use of alkyl-substituted cyclohexenols and cyclohexanols as fragrance and flavoring materials is well known. One example is carveol which has the general structure

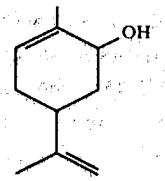

(−)-carveol is a natural component of Spearmint Oil. (+)-carveol has been found in the oils of *Fortunella margarita*, *Anethum graveolens* and *Heracleum canescens*. Further examples may be found in Actander, *Perfume and Flavor Chemicals* (1969). For example, trimethylcyclohexanol which has the structure

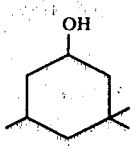

is identified as compound no. 2998 in Actander. Its fragrance is described therein as a powerful menthol-like odor but more camphoraceous and less cooling than menthol. With regard to flavor, it is described as having a camphoraceous, menthol-like taste.

Actander compound no. 432 is ortho-tertiary-butylcyclohexanol which has the structure

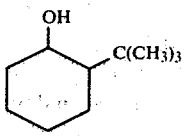

and is described as having a powerful camphoraceous-piney, mostly minty and somewhat tarry odor of great tenacity. Compound no. 433 of Actander, para-tertiary-butylcyclohexanol, having the structure

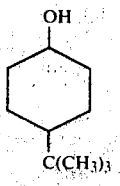

is described as having an extremely dry, woody, camphoraceous, almost tarry odor with a leather-like undertone. It is useful in perfume compositions to lend power and diffusiveness. It is used in soap fragrances along with woody notes, ionones, Cedarwood oil derivatives, and the like.

3-(Iso-camphyl-5)-cyclohexanol, compound no. 566 of Actander, has the structure

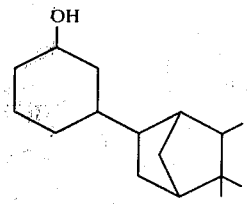

This compound has a very tenacious, mild Sandalwood-type odor that is not as sweet and balsamic as Sandalwood oil and not nearly as powerful in active use. This material is used in perfume compositions for its Sandalwood character and economical stability.

Chemicals having the 2,3,3-trimethylcyclopentene skeleton are also well known in the art of perfumery and flavor chemistry. For example, 2,2,3-trimethyl-3-cyclopenten-1-acetaldehyde having the structure

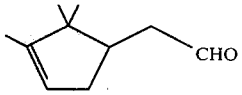

has been found in the oils of *Juniperus communis* L. and Lavandin. The corresponding acid has been found in Olibanum oil.

U.S. Pat. No. 4,052,341 discloses the use in fragrance compositions of 3-methyl-5-(2,2,3-trimethylcyclopent-3-en-1-yl)-pentan-2-ol which has the structure

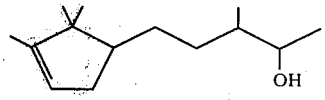

This compound is described as possessing a strong, precious woody odor reminiscent of Sandalwood oil.

SUMMARY OF THE INVENTION

In accordance with the present invention it has been found that compounds having the structure

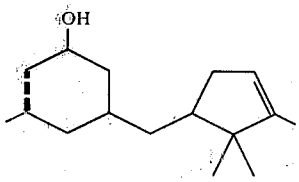

wherein the dashed line may be either a carbon-carbon single bond or carbon-carbon double bond are useful as fragrance materials. It will be recognized that the chemicals of this invention can exist in several stereoisomeric forms. The foregoing structural formula is intended to embrace the individual stereoisomers, as well as mixtures of the various stereoisomers of the substituted cyclic alcohols of this invention.

The present invention also provides efficient and economical processes for preparing these compounds. Thus, for example, the compound having the structure

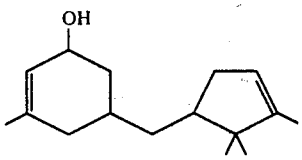

1 can be prepared by reacting an acetoacetic ester having the structure

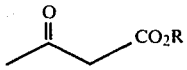

3 wherein R is lower alkyl and 2,2,3-trimethyl-3-cyclopenten-1-acetaldehyde having the structure

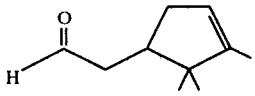

4 in the presence of a base to produce a compound having the structure

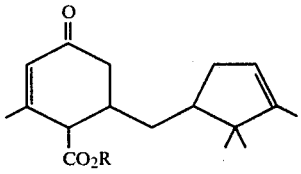

7

The product of this reaction is then decarboxylated by coventional procedures, e.g. by treatment with a base to produce a compound having the structure

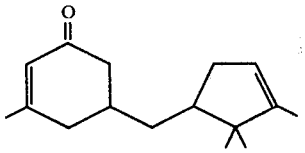

8 which upon reduction yields Compound 1.

The compound having the structure

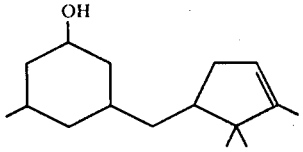

2 can be prepared by reacting an acetoacetic ester and 2,2,3-trimethyl-3-cyclopenten-1-acetaldehyde as described above. The product of this reaction is then decarboxylated and hydrogentated to produce Compound 2.

It has also been found that an admixture of Compounds 1 and 2 is also useful as a fragrance material in place of either of the individual compounds. Such a mixture can be prepared directly by reacting an acetoacetic ester (3) and 2,2,3-trimethyl-3-cyclopenten-1-acetaldehyde (4) in the presence of an organic base to produce Compound 7. Decarboxylation of Compound 7 by treatment with a base yields Compound 8 which upon reduction with a reagent such as sodium borohydride yields after workup a mixture of Compounds 1 and 2.

Finally, in accordance with the present invention it has been found that fragrance compositions can be prepared by incorporating in these compositions Compound 1 or Compound 2 or a mixture thereof in amounts effective to impart fragrance to the composition.

DETAILED DESCRIPTION OF THE INVENTION

Compounds having the structure

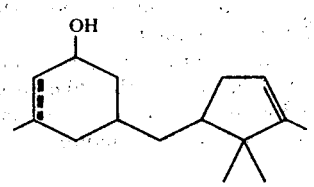

wherein the dashed line may be either a carbon-carbon single bond or a carbon-carbon double bond have been prepared. The compounds exhibit soft, warm woody notes with powdery nuances rendering these compounds useful as fragrance materials. These compounds exhibit similar odor characteristics and may be used individually or as mixtures in fragrance applications. Geometrical and optical isomers of these compounds may be separated by techniques known to the art. However, such separation is not necessary, since such mixtures of isomers can be employed directly without further separation. Additionally, mixture of these compounds wherein the dashed line may be either a carbon-carbon single bond or a carbon-carbon double bond exhibit fragrance properties similar to those of the individual compounds.

The following reaction scheme illustrates the various processes of the present invention for conveniently and inexpensively preparing such compounds:

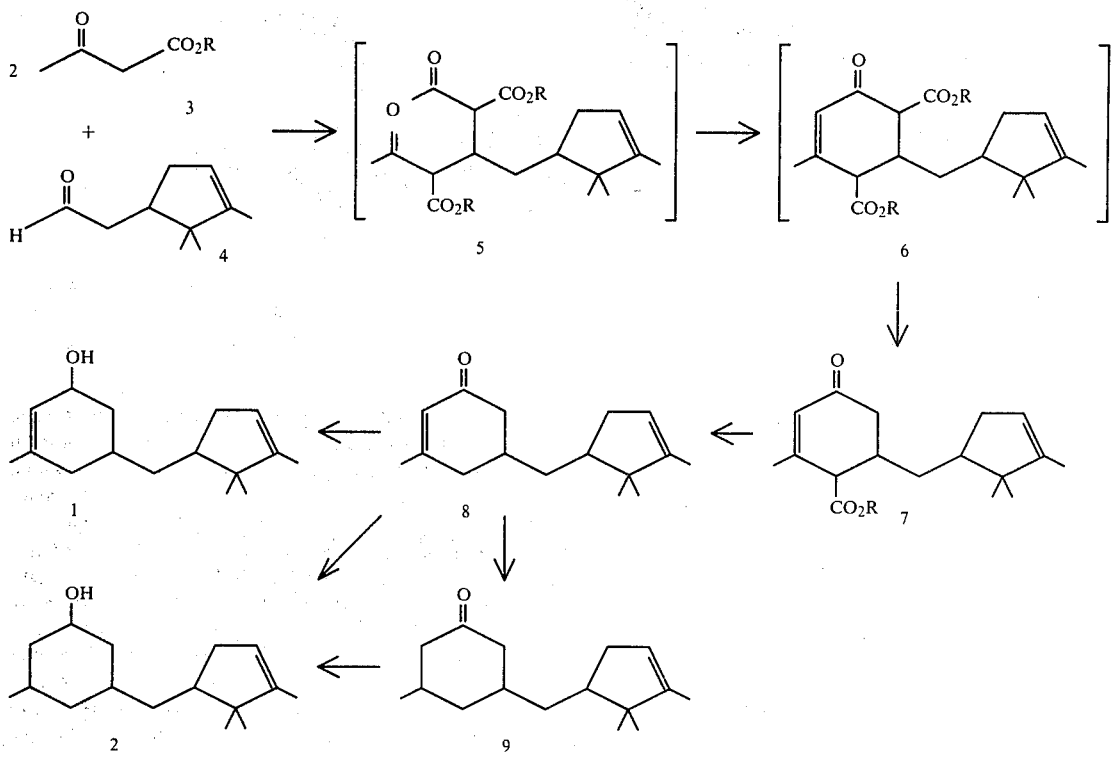

Specifically, Compound 1 can be prepared by reacting an acetoacetic ester (3) wherein R is lower alkyl, that is, R is $C_1$ to $C_5$, preferably methyl or ethyl and 2,2,3-trimethyl-3-cyclopenten-1-acetaldehyde (4) in the presence of amines such as piperidine, morpholine, and pyrolidine. This reaction proceeds through intermediate Compounds 5 and 6 to yield Compound 7. Although intermediate Compounds 5 and 6 can be separately isolated, it is preferable in the practices of the present invention that the reaction proceed directly to the formation of Compound 7. Compound 7 is then decarboxylated by conventional procedures, e.g. by treatment with base such as sodium hydroxide or potassium hydroxide or other known systems such as lithium bromide/dimethyl formamide or aqueous dimethyl sulfoxide/sodium chloride to produce Compound 8, which is reduced by treatment with a metal hydride such as di-isobutyl aluminum hydride to yield Compound 1.

Compound 2 may be prepared in an analogous manner. First, an acetoacetic ester (3) is reacted with 2,2,3-trimethyl-3-cyclopenten-1-acetaldehyde (4) to produce 7. Compound 7 is decarboxylated to produce Compound 8 which is hydrogenated by a conventional technique such as by treatment with hydrogen gas in the presence of a catalyst such as a palladium-on-carbon catalyst to produce Compound 9. Reduction of 9 by treatment with a suitable metal hydride, e.g. lithium aluminum hydride, yields Compound 2.

Alternatively, Compound 2 can be produced directly from Compound 8 by reducing the double bond and the carbonyl group of the six-membered ring with hydrogen at an elevated temperature and pressure in the presence of a catalyst and a solvent such as butyl- or isopropyl-alcohol.

As set forth hereinabove, mixtures of Compounds 1 and 2 exhibit fragrance properties similar to those of either of the individual compounds. Therefore, such a mixture can be readily substituted for either compound in fragrance applications. Such a mixture can be prepared by mixing the separately prepared compounds in desired amounts. Additionally, the mixture can be prepared directly from Compound 8 by reacting 8 with a reducing agent such as sodium borohydride.

Compound 1, Compound 2 or a mixture thereof are readily incorporated into fragrance compositions for use in detergents, soaps, perfumes, bath preparations, hair preparations, cosmetic preparations and the like. When so employed the compound or mixture should desirably be present in an amount from about 0.1% to about 80% by weight based upon the weight of the composition.

A number of examples are provided hereinafter to illustrate the preferred methods of synthesis of the compounds of this invention. The following instrumentation was used to characterize the compounds of this invention:

Gas Liquid Chromatography (GLC) analyses were obtained with a Hewlett-Packard Model 5840 A or Perkin-Elmer Model 3920 gas chromatograph using either a 10 ft, 2 mm ID glass column packed with 2% Carbowax 20 M on Chromosorb G 100/120, or a 12 ft, 2 mm ID glass column packed with 3% OV-101 on Chromosorb WHP 100/120. Nuclear Magnetic Resonance (NMR) spectra were recorded with a Varian Associates T-60A or XL 100 spectrometer, using tetramethylsilane as the internal reference. Infrared (IR) spectra were obtained with a Perkin-Elmer 137 Infracord. Mass spectra (MS), were obtained with a Hewlett-Packard 5985 Mass Spectrometer.

Unless otherwise indicated weights are in grams, temperatures are in degrees centigrade and pressures are in mm Hg.

There are also set forth hereinafter several examples illustrating fragrance compositions which include the compounds of the present invention. All of these examples are intended only to illustrate the preferred embodiments of this invention and are not in any way intended to limit the scope thereof.

EXAMPLE 1

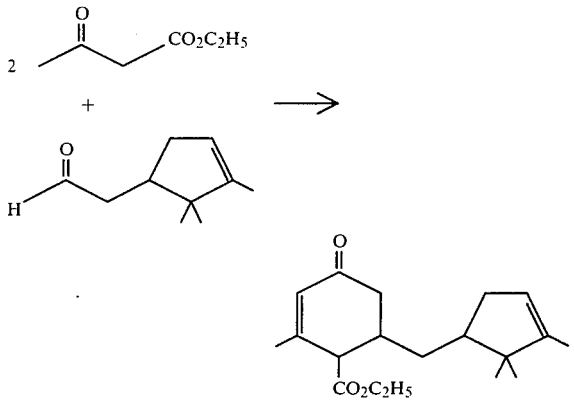

Piperidine (0.8 g) in ethanol (3.0 ml) was added over 0.5 hr to a stirred mixture of ethyl acetoacetate (143 g, 1.1 mol) and 2,2,3-trimethyl-3-cyclopenten-1-acetaldehyde (81.3 g, ca. 0.5 mol), maintaining the reaction temperature −5° to −10° C. The reaction mixture was then kept at 0° for 15 hr. A further quantity of piperidine (0.3 g) in ethanol (3.0 ml) was added, with agitation, and the mixture kept at 0° for a further 24 hr. More piperidine (0.3 g) in ethanol (3.0 ml) was added and the mixture agitated at 20° for 24 hr, then heated at reflux for 7 hr. The piperidine, water and ethanol were evaporated to provide the product in crude form (149.5 g).

EXAMPLE 2

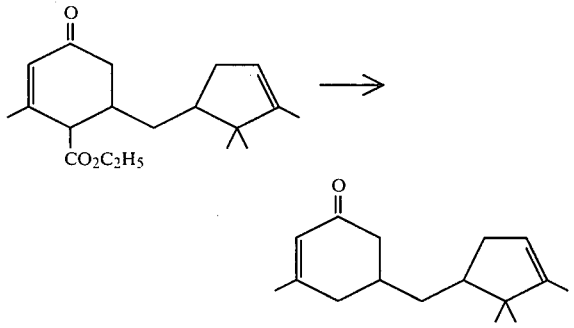

The product of Example 1 (147 g) was dissolved in methanol (400 ml), and a solution of sodium hydroxide (21.3 g, 0.53 mol) in water (400 ml) added in one portion, with agitation. The mixture was heated at gentle reflux for 19 hr, then cooled, and poured into 5% sodium bicarbonate solution (800 ml). The organic product was extracted with benzene (3×200 ml), and the combined extracts washed with brine (3×200 ml). Solvent was evaporated and the residue distilled to provide the desired product, $b_{1.5}$ 126°–133° (80.9 g). NMR ($CDCl_3$) δ 0.8 (3H, s), 1.0 (3H, s), 1.6 (3H, m), 2.0 (3H, m), 5.3 (1H, m), 5.9 (1H, m), 1.0–3.0 (10H, complex). IR (neat) 2995, 1675, 1650, 805 $cm^{-1}$. MS($^m/e$) 109, 122, 95, 121, 232.

EXAMPLE 3

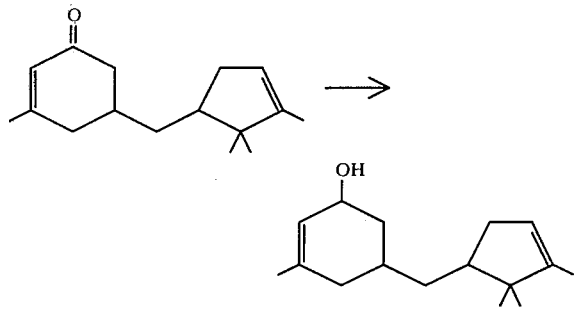

A solution of 1 N diisobutylaluminum hydride in hexane (269 ml, 0.27 mol) was added during 1 hr to a solution of the product of Example 2 (50 g, 0.22 mol) in toluene (500 ml), with stirring and cooling, such that the reaction temperature was maintained between −5° and −2° C. The cooling bath was removed and the mixture agitated for a further 1.5 hr (10°–15°). The cooling bath was replaced and methanol (25 ml) added, dropwise over 0.5 hr. After a further 0.5 hr 6% hydrochloric acid (250 ml) was added (0°–5°). The organic product was extracted with hexane (700 ml) and the extract was washed successively with 2% hydrochloric acid (2×100 ml), water (2×200 ml), 5% sodium bicarbonate solution (200 ml) and water (3×150 ml). The solvent was evaporated and the residue distilled to provide the desired product, $b_{2.0}$ 124° (22.0 g). NMR ($CDCl_3$) δ 0.8 (3H, s), 1.0 (3H, s), 1.5 (1H, exchanged with $D_2O$), 1.6 (6H, m), 4.2 (1H, m), 5.2 (1H, m), 5.4 (1H, m), 1.2–2.5 (complex). IR (neat) 3300, 2900, 1080, 805 $cm^{-1}$. MS ($^m/e$), 93, 109, 106, 91.

EXAMPLE 4

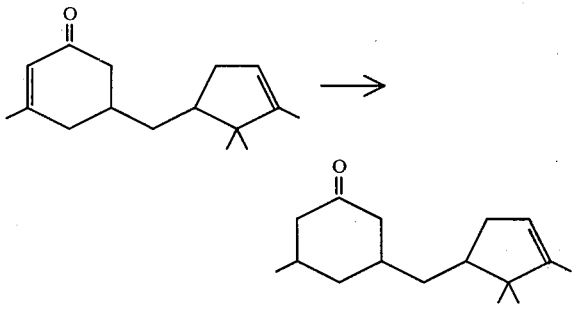

A solution of the product of Example 2 (10.0 g, 0.043 mol) in 0.3 N ethanolic potassium hydroxide (30 ml), together with 10% palladium on carbon (0.2 g) was treated with hydrogen gas at atmospheric pressure and at a temperature of 20°, until one equivalent of gas had been taken up. Solids were removed by filtration and the filtrate poured into cold (0°) dilute hydrochloric acid (55 ml). The organic product was extracted with diethyl ether (200 ml) and the extract washed successively with water (200 ml), 5% sodium bicarbonate (200 ml) and water (3×50 ml). The organic layer was dried, the solvent evaporated, and the residue distilled to provide the desired product $b_{1.0}$ 117°–119° (8.0 g). NMR ($CDCl_3$) δ 0.8 (3H, s), 1.0 (6H, m), 1.6 (3H, m), 5.1 (1H, m), 1.1–2.6 (11H, complex). IR (neat) 2900, 1710, 800 $cm^{-1}$. MS ($^m/e$) 124, 111, 109, 95, 234.

EXAMPLE 5

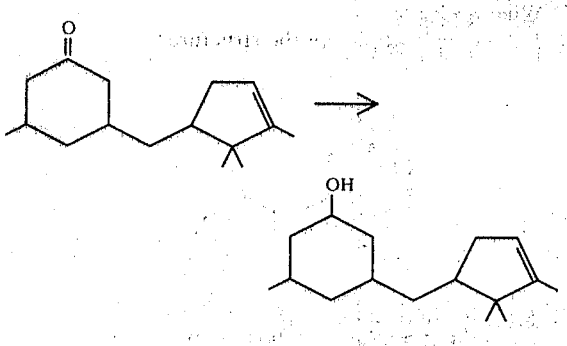

A solution of the product of Example 4 (4.0 g, 0.017 mol) in anhydrous diethyl ether (5.0 ml) was added during 1 hr to a stirred mixture of lithium aluminum hydride (0.8 g, 0.02 mol) in ether (60 ml). After stirring for a further 1 hr the reactants were cooled (5°), and water (1.0 ml), 15% sodium hydroxide solution (1.0 ml), and then water (3.0 ml) added successively to effect granulation of the solids. The solids were removed by filtration and the organic layer washed sucsessively with 5% sodium bicarbonate solution (100 ml) and water (3×50 ml). The organic layer was dried, the solvent evaporated, and the residue distilled to provide the product $b_{0.5}$ 117°-119° (3.0 g). NMR ($CDCl_3$) δ 0.8-1.0 (9H, complex), 1.2 (1H, exchanged with $D_2O$), 1.6 (3H, m), 3.6 (1H, m), 5.2 (1H, m), 1.0-2.4 (13H, complex). IR (neat) 3300, 2900, 1090, 800 $cm^{-1}$. MS ($^m/e$) 95, 109, 107, 67, 236.

EXAMPLE 6

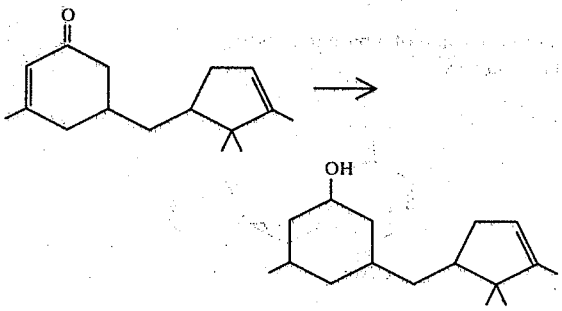

The product of Example 2 (116 g, 0.5 mol), butyl alcohol (73 ml), potassium hydroxide (0.05 g) and copper chromite (7.0 g) were charged to a 500 ml autoclave, and the stirred mixture heated at 155°-160° under 300 psi of hydrogen. When the uptake of hydrogen gas had stopped the mixture was cooled (20°) and the autoclave evacuated before purging with nitrogen. The reaction mixture was filtered, the solvent evaporated and the residue immediately distilled to provide an oil (103 g), which was shown by GLC and spectral analysis to be the desired product.

EXAMPLE 7

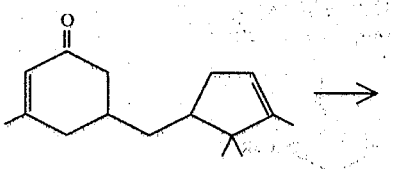

-continued

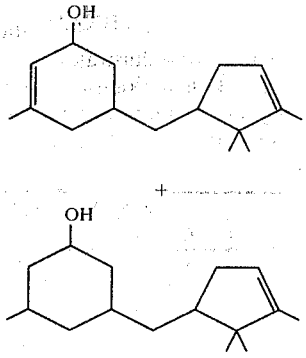

A solution of the product of Example 2 (70 g, 0.3 mol) in methanol (25 ml) was added dropwise, over 0.8 hr, to a stirred solution of sodium borohydride (10.0 g, 0.26 mol) in methanol (125 ml), with cooling, such that the reaction temperature was maintained −5° to −2°. The mixture was then allowed to warm to 20° and agitation continued for 4 hr. The mixture was once again cooled (0°) before acidification with dilute hydrochloric acid (dropwise addition). The organic product was extracted with diethyl ether (3×100 ml) and the combined organic extracts washed successively with water (3×100 ml), 5% sodium bicarbonate solution (100 ml) and water (3×100 ml). The organic layer was dried, the solvent evaporated, and the residue distilled to provide an oil $b_{2.0}$ 129°-130° (43.0 g), which was shown by GLC and spectral analysis to be a mixture of alcohols 1 and 2.

EXAMPLE 8

The following illustrates the utility of Compound 1 in fragrance compositions of the chypre type. Compound 1 is the novel compound of this invention as previously defined.

| | Chypre |
|---|---|
| pts/wt | Component |
| 250 | Oil Bergamot |
| 130 | Oil Orange Sweet |
| 200 | Methyl Ionone |
| 20 | Oil Rose |
| 50 | Jasmin Absolute |
| 5 | Oil Basil Sweet |
| 5 | Oil Estragon |
| 3 | Benzyl Salicylate |
| 3 | Oil Ylang Extra |
| 6 | Cinnamic Alcohol |
| 18 | Eugenol |
| 3 | Aldehyde C-14 |
| 2 | 10% Sol. Aldehyde C-12 MNA In Diethyl Phthalate Odorless |
| 10 | 10% Sol. Aldehyde C-11 Undecylenic in Diethyl Phthalate Odorless |
| 10 | Civet Absolute |
| 40 | Coumarin |
| 30 | Labdanum Resinoid |
| 30 | Musk Ketone |
| 30 | Oakmoss Absolute |
| 30 | Oil Patchouly |
| 5 | Vanillin |
| 50 | Oil Vetiver Reunion |
| 70 | Compound 1 |
| 1000 | |

EXAMPLE 9

The following illustrates the utility of Compound 2 of this invention in fragrance compositions exhibiting a woody floral bouquet. Compound 2 is a novel compound in accordance with the present invention as previously defined.

| WOODY FLORAL BOUQUET | |
|---|---|
| pts/wt | Component |
| 20 | Musk Ketone |
| 40 | Musk Ambrette |
| 10 | Heliotropin |
| 5 | Labdanum Resinoid |
| 5 | 10% Sol. Vanillin in Diethyl Phthalate Odorless |
| 20 | Coumarin |
| 5 | Oakmoss Absolute |
| 5 | Phenylethyl Phenylacetate |
| 60 | Rhodinol Extra |
| 10 | Lyral |
| 40 | Methyl Ionone Gamma |
| 60 | Oil Vetiver Reunion |
| 80 | Vetiveryl Acetate |
| 10 | 10% Sol. Indol in Diethyl Phthalate Odorless |
| 25 | 10% Sol. Cyclamenaldehyde in Diethyl Phthalate Odorless |
| 5 | Phenylethyl Iso Butyrate |
| 10 | Dimethyl Phenylethyl Carbinol |
| 80 | Phenyl Ethyl Alcohol |
| 20 | Amyl Cinnamic Aldehyde |
| 40 | Linalool Synthetic |
| 5 | Linalyl Cinnamate |
| 120 | Hydroxy Citronellal |
| 20 | Oil Ylang Extra |
| 40 | Oil Rose Bulgarian |
| 40 | Jasmin Absolute |
| 10 | Oil Bergamot Rectified |
| 5 | Oil Geranium Reunion |
| 5 | 10% Sol. Aldehyde C-9 in Diethyl Phthalate Odorless |
| 5 | 10% Sol. Aldehyde C-10 in Diethyl Phthalate Odorless |
| 10 | 10% Sol. Aldehyde C-11 Undecylenic in Diethyl Phthalate Odorless |
| 5 | 10% Sol. Aldehyde C-12 MNA in Diethyl Phthalate Odorless |
| 5 | Oil Neroli Maroc |
| 20 | Benzyl Acetate |
| 10 | 10% Sol. Aldehyde in Diethyl Phthalate Odorless |
| 80 | Compound 2 |
| 10 | Oil Styrax Distilled |
| 40 | Acetyl Cedrene |
| 20 | 10% Sol. Pentadecanolide in Diethyl Phthalate Odorless |
| 1000 | |

EXAMPLE 10

The following illustrates the utility of a mixture of Compounds 1 and 2 as described hereinabove in a fragrance composition exhibiting a Sandalwood base fragrance.

| SANDALWOOD BASE | |
|---|---|
| pts/wt | Component |
| 20 | Oil Balsam Gurjon |
| 80 | Oil Amyris |
| 100 | Osyrol BBA |
| 800 | Mixture of Compounds 1 and 2 |
| 1000 | |

As will be obvious to one skilled in the art many modifications, variations, and alterations can be made in the practices of this invention without departing from the spirit and scope thereof as set forth in the claims which follow.

What is claimed is:

1. A compound having the structure

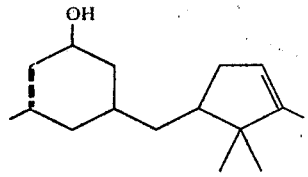

wherein the dashed line may be either a carbon-carbon single bond or a carbon-carbon double bond.

2. A mixture of compounds in accordance with claim 1 wherein the dashed line may be a carbon-carbon double bond or a carbon-carbon single bond.

3. A method of preparing a compound in accordance with claim 1 wherein the dashed line is a carbon-carbon double bond which comprises reacting an acetoacetic ester having the structure

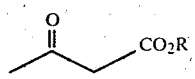

wherein R is lower alkyl and 2,2,3-trimethyl-3-cyclopenten-1-acetaldehyde having the structure

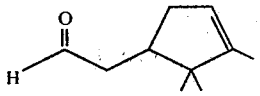

in the presence of a base to produce a compound having the structure

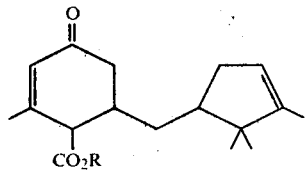

decarboxylating this compound to produce a compound having the structure

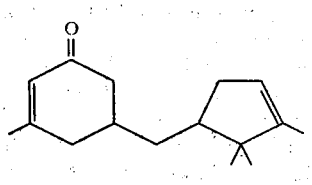

and then reducing this compound.

4. A method of preparing a compound in accordance with claim 1 wherein the dashed line is a carbon-carbon single bond which comprises reacting an acetoacetic ester having the structure

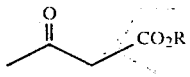

wherein R is lower alkyl and 2,2,3-trimethyl-3-cyclopenten-1-acetaldehyde having the structure

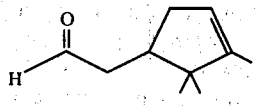

in the presence of a base to produce a compound having the structure

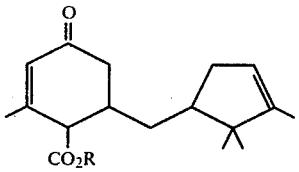

decarboxylating this compound to produce a compound having the structure

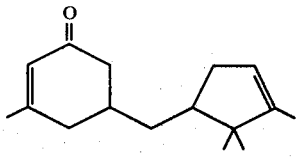

hydrogenating this compound to produce a compound having the structure

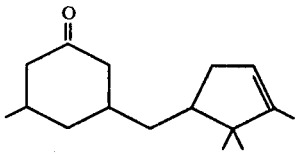

and then further reducing this compound.

5. A method of preparing a compound in accordance with claim 1 wherein the dashed line is a carbon-carbon single bond which comprises reacting an acetoacetic ester having the structure

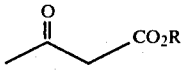

wherein R is lower alkyl and 2,2,3-trimethyl-3-cyclopenten-1-acetaldehyde having the structure

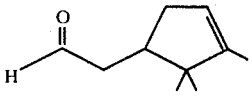

in the presence of a base to produce a compound having the structure

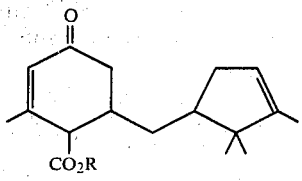

decarboxylating this compound to produce a compound having the structure

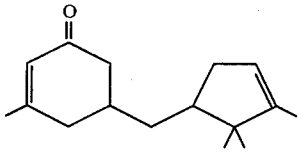

and then hydrogenating this compound.

6. A method of preparing a mixture in accordance with claim 2 which comprises reacting an acetoacetic ester having the structure

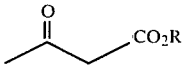

wherein R is lower alkyl and 2,2,3-trimehtyl-3-cyclopenten-1-acetaldehyde having the structure

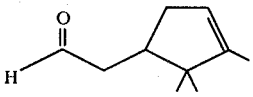

in the presence of a base to produce a compound having the structure

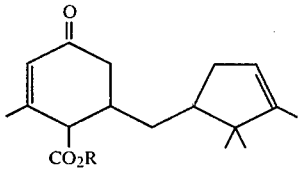

decarboxylating this compound to produce a compound having the structure

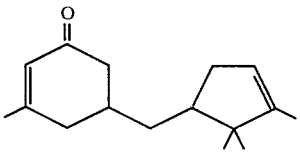

and reacting this compound with a reducing agent.

7. A fragrance composition which comprises an amount of the compound of claim 1 effective to impart fragrance thereto in combination with conventional fragrance ingredients.

8. A fragrance composition in accordance with claim 7 wherein said effective fragrance-imparting amount is an amount from about 0.1% to about 80% by weight of said compound based upon the weight of said composition.

9. A fragrance composition which comprises an amount of the mixture of claim 2 effective to impart fragrance thereto in combination with conventional fragrance ingredients.

10. A fragrance composition in accordance with claim 9 wherein said effective fragrance-imparting amount is an amount from about 0.1% to about 80% by weight of said composition based upon the weight of said composition.

11. A method of preparing a fragrance composition which comprises incorporating in said composition an amount of the compound of claim 1 effective to impart fragrance thereto.

12. A method in accordance with claim 11 wherein said fragrance-imparting amount is from about 0.1% to about 80% by weight of said compound based upon the weight of said composition.

13. A method of preparing a fragrance composition which comprises incorporating in said composition an amount of the mixture of claim 2 effective to impart fragrance thereto.

14. The method of claim 13 wherein said fragrance-imparting amount is from about 0.1% to about 80% by weight of said mixture based upon the weight of said composition.

* * * * *

UNITED STATES PATENT AND TRADEMARK OFFICE

CERTIFICATE OF CORRECTION

PATENT NO. : 4,188,310

DATED : February 12, 1980

INVENTOR(S) : Brian J. Willis and John M. Yurecko, Jr.

It is certified that error appears in the above-identified patent and that said Letters Patent are hereby corrected as shown below:

In the Abstract, change the structural formula from

" 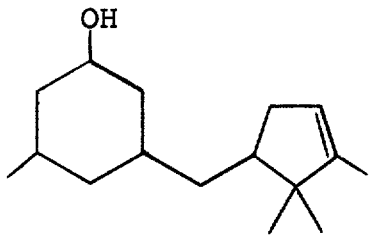

"

to

-- 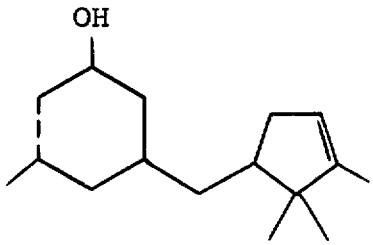

--

UNITED STATES PATENT AND TRADEMARK OFFICE

CERTIFICATE OF CORRECTION

PATENT NO. : 4,188,310

DATED : February 12, 1980

INVENTOR(S) : Brian J. Willis and John M. Yurecko, Jr.

It is certified that error appears in the above—identified patent and that said Letters Patent is hereby corrected as shown below:

Column 4, line 40 change the structural formula from

" 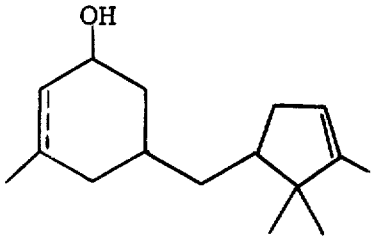 "

to

-- 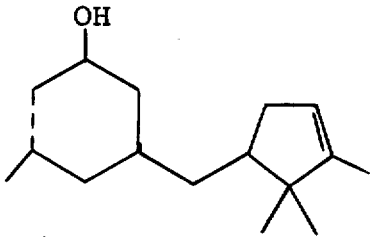 --

Signed and Sealed this

*Twenty-seventh* Day of *May 1980*

[SEAL]

*Attest:*

*Attesting Officer*

SIDNEY A. DIAMOND

*Commissioner of Patents and Trademarks*